United States Patent [19]

Hehl

[11] 4,290,356

[45] Sep. 22, 1981

[54] ACTUATOR MECHANISM FOR A PRINT HAMMER OR THE LIKE

[75] Inventor: Walter H. Hehl, Steinenbronn, Fed. Rep. of Germany

[73] Assignee: International Business Machines Corporation, Armonk, N.Y.

[21] Appl. No.: 66,156

[22] Filed: Aug. 13, 1979

[30] Foreign Application Priority Data

Aug. 29, 1978 [DE] Fed. Rep. of Germany ..... 2837550

[51] Int. Cl.[3] ..... B41J 9/30

[52] U.S. Cl. ..... 101/93.34; 101/93.48; 335/234; 335/207

[58] Field of Search .... 101/93.02, 93.03, 93.29–93.34, 101/93.48; 335/186, 81, 82, 179, 182, 183, 205, 206, 207, 229–239, 306

[56] References Cited

U.S. PATENT DOCUMENTS

| | | | |
|---|---|---|---|
| 3,273,091 | 9/1966 | Wales | 335/207 |
| 3,279,362 | 10/1966 | Helms | 101/93.34 |
| 3,515,452 | 2/1976 | Malmborg | 335/81 X |
| 3,671,893 | 6/1972 | Edgar et al. | 101/93.48 X |
| 3,815,066 | 6/1974 | Vinal | 335/207 |
| 4,004,505 | 1/1977 | Magnenet | 101/93.48 |
| 4,054,944 | 10/1977 | Lau | 335/207 |
| 4,192,230 | 3/1980 | Blom et al. | 400/124 X |

FOREIGN PATENT DOCUMENTS

| | | | |
|---|---|---|---|
| 1264120 | 3/1968 | Fed. Rep. of Germany | 101/93.02 |
| 1514744 | 6/1969 | Fed. Rep. of Germany | 335/207 |

OTHER PUBLICATIONS

Proebsker, IBM Tech. Discl. Bulletin, vol. 12, No. 7, Dec. 1971, p. 2238.

*Primary Examiner*—Edward M. Coven
*Attorney, Agent, or Firm*—John S. Gasper

[57] ABSTRACT

A moving element is held without contacts in a relatively stable holding position, out of which it is released by the application of an external force. The relatively stable holding position is obtained by superimposing a potential field of magnet edges by a further potential field based on a mechanical bias of the moving element or a magnet in such a manner that the curve of the total potential has a trough corresponding to the holding position. By applying an external force, the moving element is moved to a peak position of the total potential curve, whence it is subject to accelerating forces. Preferably rare earth magnets are used to form the potential field of magnet edges. In a print hammer actuator the moving element includes a moving coil.

6 Claims, 18 Drawing Figures

FIG. 4A
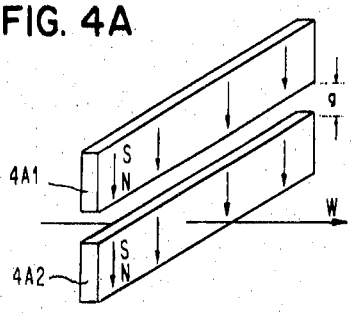
ATTRACTIVE MAGNETIC EDGE FORCES IN THE CASE OF TRANSVERSAL MAGNETIZATION
FIG. 4B
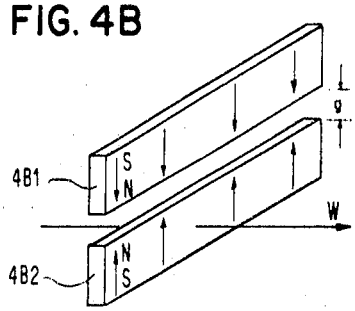
REPULSIVE MAGNETIC EDGE FORCES IN THE CASE OF TRANSVERSAL MAGNETIZATION
FIG. 5A
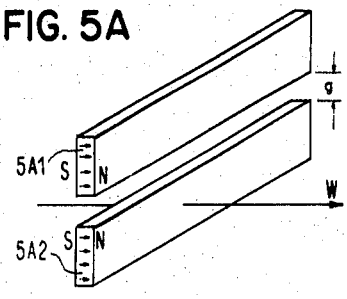
MAGNETIC EDGE FORCES IN THE CASE OF PARALLEL AND UNIDIRECTIONAL MAGNETIZATION
FIG. 5B
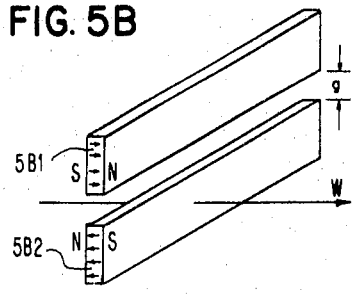
MAGNETIC EDGE FORCES IN THE CASE OF PARALLEL AND ANTIPARALLEL MAGNETIZATION
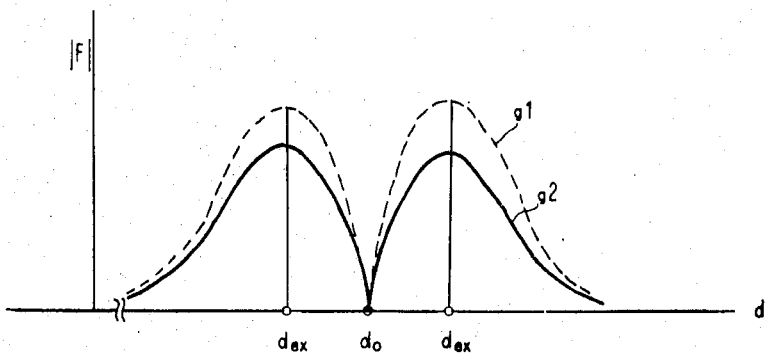
FIG. 6

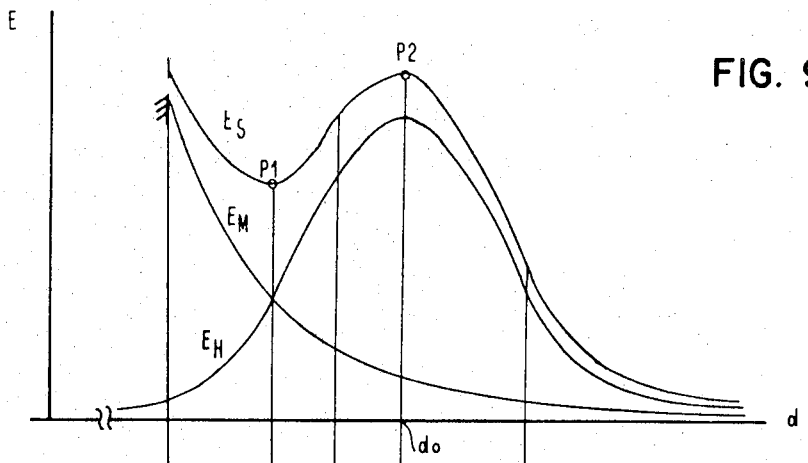
FIG. 9
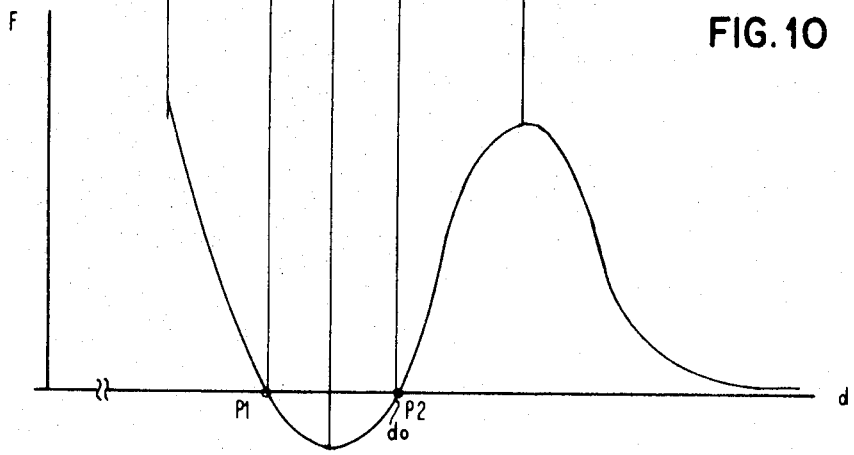
FIG. 10
FIG. 14
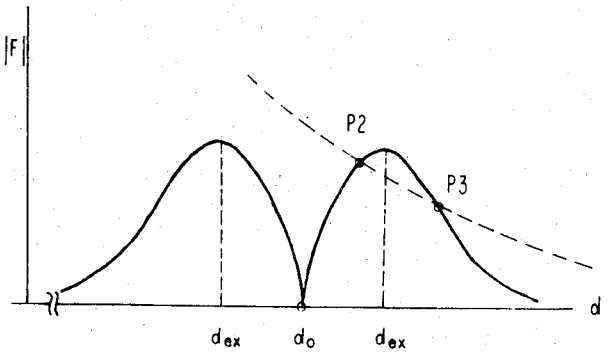
FIG. 11
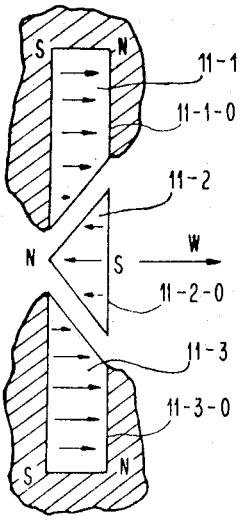

ACTUATOR MECHANISM FOR A PRINT HAMMER OR THE LIKE

BACKGROUND OF THE INVENTION

The invention concerns actuator mechanisms and particularly actuating mechanisms having a contactless holding system means for a moving actuator element as well as the design of such a holding system.

Independently of their application, the principle of such holding systems is to keep a moving actuator in a relatively stable initial position. If this actuator is to be moved out of this relatively stable position, this is effected by the application of a force.

As an example of such a typically mechanically acting holding system, so-called snap-action switches may be quoted, in which a moving contact element is kept in a holding position by means of a spring for as long as said element is not moved beyond a particular critical position. After this critical position has been reached, the actuator follows a forcibly prescribed path, along which it is initially accelerated under the influence of the spring.

From printer technology, spring-driven print hammers are known (e.g., from Deutsche Offenlegungsschrift German Pat. No. 1 264 120 which are kept in their initial position against the force of a spring by means of a holding magnet. Upon release of the print hammer, this magnet is correspondingly energized, so that its holding force is no longer maintained, and the print hammer is driven by the biased spring.

However, all such holding systems are not free from contacts, i.e., the disadvantages these entail, such as contact bounces and wear, have to be tolerated, or additional measures have to be taken to avoid them.

SUMMARY OF THE INVENTION

Therefore, it is the object of the invention to provide a holding system which is free from contacts and which, in addition, has the advantage of a high action force. Action force in this context is assumed to mean the following: If the actuator is moved out of its relatively stable holding position, i.e., if it is released, this requires the use of a force F1. After its release, the actuator is to be accelerated by a higher force F2. In addition to being suitable for switches, the invention can be used for print hammer drives of electronic data processing systems.

From the latter field, so-called moving coil driven print hammers are known (e.g., from U.S. Pat. No. 3,279,362). The moving coil is movably arranged in a magnetic field by which it is interspersed. The print hammer is arranged on the moving coil body. When the moving coil is electrically energized for printing, it is subjected to a force by which it is deflected in the direction of print.

The efficiency of the print hammer differs during its movement. Initially, it is very low, as electric energy is needed for building up the magnetic field of the moving coil and for overcoming its ohmic resistance. If the efficiency could be made more favorable in the initial phase, this would lead to the final print hammer speed necessary for printing to be obtained more rapidly and thus to a higher print capacity, or to lower power requirements for the energization of the moving coil.

Thus, in accordance with the invention, the print hammer is not to be initially operated by energizing the moving coil as usual. Energization of the moving coil is to start only after the print hammer has been accelerated to a corresponding initial speed. This initial speed could be obtained by releasing the print hammer, for example, from a spring-biased position and by subjecting it to the usual moving coil energization only after a particular time has elapsed.

Such an initial speed of the print hammer can also be obtained by using the contact-free holding system in accordance with the invention, which eliminates undesired wear and bouncing.

BRIEF DESCRIPTION OF THE DRAWINGS

FIG. 4A is a simplified representation of attractive magnetic edge forces in the case of transversal magnetization, FIG. 4B is a simplified representation of repulsive magnetic edge forces in the case of transversal magnetization, FIG. 5A is a simplified representation of magnetic edge forces in the case of parallel and unidirectional magnetization, FIG. 5B is a simplified representation of magnetic edge forces in the case of parallel and anti-parallel magnetization, FIG. 6 is a functional representation of the force acting, in accordance with FIGS. 4A, 4B, 5A, and 5B, in the operating direction as a function of distance.

FIG. 9 is a potential representation of a magnet edge holding system in accordance with FIG. 2.

FIG. 10 is a representation of the force of a magnet edge holding system in accordance with FIG. 2 as a function of distance, whereby this representation can be derived by differentiating the function in accordance with FIG. 9.

FIG. 11 is a schematic representation of a double magnet edge holding system with only three specially designed magnets.

FIG. 14 is a functional representation of the configuration of FIG. 13.

DETAILED DESCRIPTION OF THE INVENTION

Figure 1:
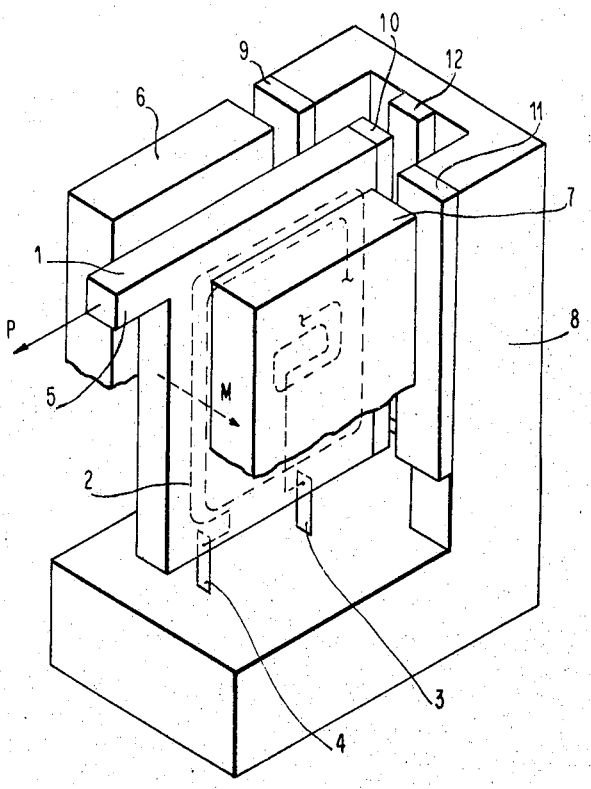
FIG. 1 is a diagrammatic representation of a moving coil print hammer drive with a magnet edge holding system.

In the following description of the invention reference will be made, amongst others, to so-called edge forces. For this reason it will be explained initially what magnetic edge forces mean.

With regard to the qualitative identification of the usual magnet forces, attention is drawn to the well-known fact that when two identical magnet poles are brought close to each other, high repulsive forces occur which decrease as the distance between the magnet poles is reduced. In addition to such forces encountered in connection with repulsive configurations, there are, of course, those occurring in connection with attractive configurations. In the latter case, unidentical magnet poles are brought close to each other.

Magnetic edge forces are forces which occur as mutually attractive or repulsive magnets are moved past each other in the operating direction.

The potential conditions connected with such processes will be considered in greater detail below. It is pointed out that by means of the rare earth magnets (RE magnets) which have become known more recently—see also "Proceedings of the second international workshop on rare earth—Cobalt permanent magnets and their applications", June 8–11, 1976, University of Dayton, Ohio, U.S.A., magnetically open configurations with high forces of either sign can be realized. These RE magnet circuits can be computed more accurately, since rare earth magnets maintain their characteristics without being accommodated in a closed magnetic circuit.

Geometrically, such RE magnet configurations can form edge-type arrangements of hard or soft magnetic material. Edge means the narrow side of a small RE magnet, whose dimensions are a function of the forces to be produced. RE magnets which are relatively small in size are marked by high forces.

FIGS. 4A, 4B, 5A, and 5B diagrammatically show how magnetic edges of small cuboid rare earth magnets can be moved past each other. The magnetization vector M occurring in these small magnets is marked by small arrows. The magnetization vector is assumed to point from the south pole S to the north pole N. A comparison of the magnetization vectors in the magnets 4A1 and 4A2 shows that the arrangement in accordance with FIG. 4A is an attractive magnet configuration (the magnetization vectors of both magnets pointing in the same direction). The magnet 4A1 is assumed to be stationary; the magnet 4A2 is assumed to be moved past the magnet 4A1 at a distance g in the direction of the arrow designated as W, i.e., perpendicularly to the direction of magnetization. The forces of attraction occurring in the direction of magnetization are highest when the magnet 4A2, as shown in FIG. 4A, is below the magnet 4A1, but in this position the component of the force of attraction in the direction of operation W equals 0.

For the purpose of this description it is agreed that where the operating direction W and the direction of magnetization extend perpendicularly to each other, the magnetization occurring is referred to as transversal, and that where the operating direction W and the direction of magnetization extend in the same or in an opposite direction, the magnetization occurring is referred to as parallel and anti-parallel respectively.

Analagously to FIG. 4A, FIG. 4B shows a repulsive magnet configuration in the case of transversal magnetization.

The magnetization vectors in the magnets 4B1 and 4B2 extend anti-parallel to each other, so that as the magnet 4B2 is moved past the stationary magnet 4B1 in the direction W, repulsive forces become active.

The repulsive forces in the direction of magnetization are highest when both magnets 4B1 and 4B2, are mutually aligned. However, in such a position the component of the repulsive force in the direction W is equal to 0.

A subsequent theoretical examination (see FIG. 6) of the arrangements in accordance with FIGS. 4A and 4B shows that the attractive (FIG. 4A) and the repulsive edge forces (FIG. 4B), respectively, have maximum values in the direction of operation W to the left and right of the position of the magnets assumed to be mutually aligned.

The potential fields for magnet edges in open configurations are computed on the basis of the scalar magnetic potential, whereby the magnet is solely defined by (fictitious) magnetic surface charges; the forces resulting from numerical integration of the product moment x field strength over the magnet surfaces. For a magnet configuration of FIGS. 4A and 4B a potential distribution in accordance with FIG. 6 is obtained. The absolute magnitude of the force |F| between the magnet edges in the direction of operation perpendicular to the direction of magnetization is chosen as the ordinate, while the position d of the magnets projected onto the arrow-marked direction W forms the abscissa. One parameter in this representation is the distance g between the magnet edges in a mutually aligned position. For a smaller distance g (designated as g1 in FIG. 6) higher edge forces become active than for a greater distance g2. The function diagram in accordance with FIG. 6 is the same for attractive and repulsive magnet configurations in the case of transversal magnetization; the only difference being that in one case attractive and in the other repulsive forces are concerned.

The potential energy $V_m(x)$ of a magnetic edge as a function of the lateral movement d can be expressed in approximation by the formula $$V_m(x) = \pm \frac{a}{1 + (d - d0/b)^2}$$

where d is the position of the magnet edges projected onto the operating direction W, d0 is the zero position, a and b are parameters dependent upon the geometry of the magnets and upon a minimum gap.

The extreme attractive and repulsive forces, respectively, occur at $$d_{ex} = d0 \pm b/\sqrt{3}$$

and are the magnitude $$F_{ex} = 3 \cdot \sqrt{\frac{3}{8}} \cdot \frac{a}{b}.$$

Thus, it will be seen that the extreme attractive and repulsive forces in the operating direction W occur perpendicularly to the direction of magnetization at a corresponding lateral stagger of the magnets assumed to be mutually aligned.

FIGS. 5A and 5B show arrangements representing magnetic edge forces in the case of parallel and unidirectional and parallel and anti-parallel magnetization, respectively.

The magnet 5A1 in FIG. 5A is assumed to be stationary; the magnet 5A2 is moved past the former magnet at a distance g in the direction W. The operating direction W and the direction of magnetization (marked by small arrows pointing from south to north) extend parallel to each other in the same direction. At close range, i.e., at a slight displacement (of the order of the edge width) of the magnets 5A1 and 5A2 relative to each other, the arrangement of FIG. 5A behaves like a repulsive configuration. This can be explained as follows: The magnetic charges are assumed to be combined on the magnet surfaces from which the arrows indicating the direction of magnetization start or on which they end. Between these surfaces, forces are to be active. "S" and "N" which are opposite to each other cause a repulsion (in the direction perpendicular to the operating direction W). As the magnets become increasingly displaced relative to each other, repulsive forces become active (in the direction W), which subsequently decrease, being subject to reversal when the influence of the attractive pole faces is either greater than or cancels that of the repulsive pole faces.

Analogously, the arrangement in accordance with FIG. 5B can be interpreted as an attractive configuration at close range of the magnets.

The functional representation in FIG. 6 thus does not only apply to the arrangements of FIGS. 4A and 4B but also, in approximation, to the close range of the magnet arrangements in accordance with FIGS. 5A and 5B.

FIGS. 7A, 7B, 8A, and 8B are simplified representations of symmetrical double magnet edges.

Figure 7A:
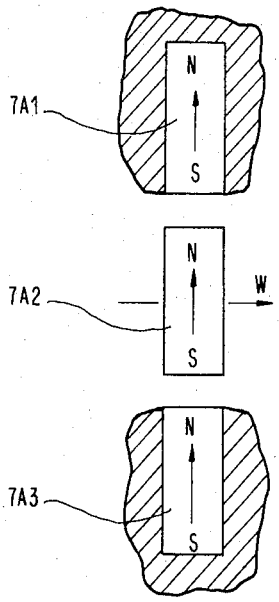
FIG. 7A is a simplified representation of a symmetrical double magnet edge for attractive magnetic edge forces in the case of transversal magnetization.

Thus, for example, in accordance with the representation of FIG. 7A, a magnet 7A2, magnetized as indicated, is moved between the magnets 7A1 and 7A3 in the arrow-marked direction W. The arrangement is assumed to be symmetrical, so that conditions at the edge between the magnets 7A1 and 7A2 are the same as those between the magnets 7A2 and 7A3. As the representation concerns attractive edge forces in the case of transversal magnetization, and the magnet 7A2 *cannot* escape perpendicularly to its operating direction W, the arrangement shown in FIG. 7A assumes a quasi-stable position, taking into account the edge forces of FIG. 6. This means that in the position in which it is aligned relative to the magnets 7A1 and 7A3, the magnet 7A2 is not subject to forces in the direction W. In this position, the forces of attraction between the magnets are greatest anyhow in the direction of magnetization, so that the magnet 7A2 can be moved out of its quasi-stable position only by the application of external forces. If the magnet were on the left or right outside its aligned position, the forces occurring in the direction W would force it back to its aligned position.

Figure 7B:
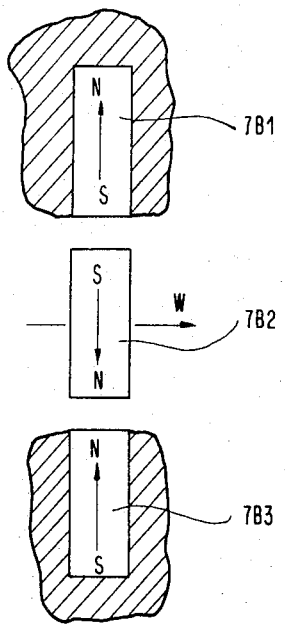
FIG. 7B is a simplified representation of a symmetrical double magnet edge for repulsive magnetic edge forces in the case of transversal magnetization.

In the case of repulsive magnetic edge forces at transversal magnetization in accordance with FIG. 7B, magnet 7B2 movable in the direction W would not be subject to a repulsive force in a position in which it is aligned relative to the magnets 7B1 and 7B3. However, on the left and right outside this aligned position, repulsive forces would be exerted on the magnet 7B2 in the direction W. (The boundary condition continues to apply, according to which the magnet 7B2 cannot escape perpendicularly to its operating direction W.)

The representation of the potential conditions $E=f(d)$ for an arrangement in accordance with FIG. 7B as a function of the distance d of the magnet 7B2 from its aligned position relative to the other magnets leads to a curve EH in FIG. 9. This representation shows that the peak of this curve EH represents an unstable position. This becomes even clearer from the curve in accordance with FIG. 6, which is obtained from the derivation of the curve EH in FIG. 9.

In an aligned position d0, the force in the direction W equals 0. Slight deviations from this position lead to the repulsive forces to increase up to the point $d_{ex}$. These forces cause the magnet 7B2 to be accelerated either in the W direction or opposite thereto, thus driving said magnet from the aligned position d0 (zero position). These driving repulsive forces are to be used to initially accelerate the magnet 7B2 in the direction W. It should be ensured, however, that the magnet 7B2 assumes a quasi-stable position in its zero state, which, as previously described, is not possible with an arrangement of FIG. 7B. Therefore, in accordance with FIG. 3, a further magnet 3-4, is added to the arrangement in FIG. 7B. The magnets 3-1 and 3-3, corresponding to the magnets 7B1 and 7B3 in FIG. 7B, are stationarily arranged. Between them, the magnet 3-2 (corresponding to the magnet 7B2 in FIG. 7B) is to be moved in the direction W. To ensure that it is in a quasi-stable position, the magnet 3-4 is stationarily arranged at a stagger relative to the zero position d0 opposite to the operating direction W. Its direction of magnetization corresponds to that of the movable magnet 3-2. Thus, there are repulsive forces between the magnets 3-2 and 3-4. To obtain an idea of the total potential which is a function of the magnets 3-1, 3-2, 3-3, and 3-4, the potential distribution EH of FIG. 9, which is a function of the magnets 3-1, 3-2, and 3-3, and the potential distribution EM, which is a function of the magnet 3-4, are to be added. The total potential distribution thus obtained as a function of the distance from the zero position d0 corresponds to that of the curve ES. This curve has a trough with the lowest point P1 and a threshold with the peak P2. The forces dependent upon the total potential of the curve ES in FIG. 9 are obtained by derivation of this curve. The distribution of forces as a function of distance is shown in FIG. 11. Point d0 indicates the aligned position (marked by a broken line in FIG. 3) of the magnet 3-2 relative to the magnets 3-1 and 3-3. In the representation of FIG. 10 this position is marked by the point P2. The point corresponding to the lowest point P1 in the representation ES of FIG. 9 is also designated as P1 in FIG. 10. This point P1 is relatively stable in contrast to point P2, i.e., slight displacements of the magnet 3-2 within a range not exceeding P2 lead to repulsive forces which invariably drive the movable magnet 3-2 back to a position corresponding to point P1. If the arrangement of FIG. 3 were directly on the right adjacent to point P2 (FIG. 9), repulsive forces would be exerted in the direction W on the movable magnet 3-2 of FIG. 10. These repulsive forces would accelerate said magnet to the desired initial speed. Thus, point P1 represents a relatively stable holding position for the magnet 3-2, while point P2 designates an unstable position, from which onward the magnet is subjected to an initial acceleration in the direction W.

Figure 3:
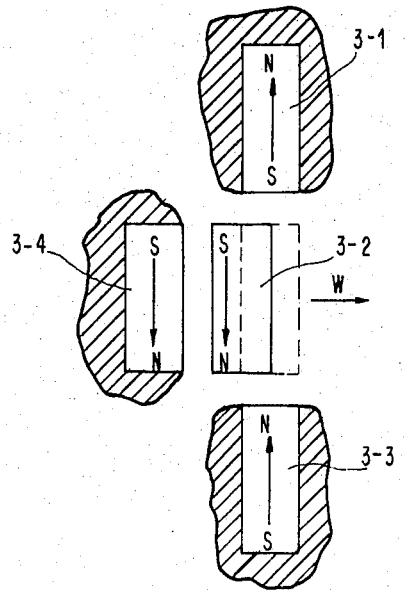
FIG. 3 is a typical representation of a magnet edge holding system consisting of a double magnet edge for repulsive magnetic edge forces in the case of transversal magnetization and of a magnet effecting a contact-free holding position.

As previously mentioned in connection with FIG. 9, the curve EM is dependent upon the magnet 3-4. The configuration of the magnets 3-1, 3-2, 3-3, and 3-4 in FIG. 3 is to be chosen in such a manner that a trough is formed in any case in the curve ES in accordance with FIG. 9. Failing the formation of such a trough, a contactless holding position designated by point P1 would not be obtained for the magnet 3-2.

The trough in the curve ES of FIG. 9, which is necessary to ensure said holding position, could also be obtained by subjecting the magnet 3-2 to a corresponding spring bias. The potential representation for this spring bias in the direction W should essentially correspond to the course of the curve EM in FIG. 9. The superposition of such a spring characteristic by the curve EH in FIG. 9 is to lead to a course of the total potential, which corresponds to that of the curve ES with a trough. For an arrangement in which the magnet 3-2 would be biased by a mechanical spring (this spring is not shown), the magnet 3-4 could be omitted. The effect of such an arrangement would be the same as that of the arrangement in accordance with FIG. 3.

Figure 8A:
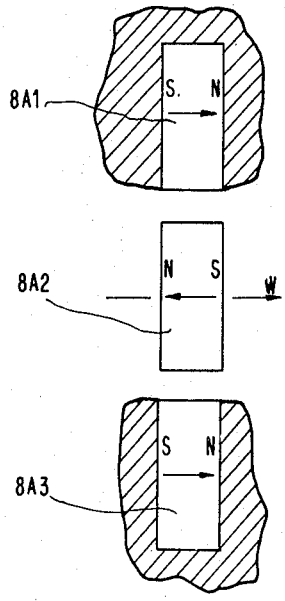
FIG. 8A is a simplified representation of a symmetrical double magnet edge for magnetic edge forces in the case of parallel and anti-parallel magnetization.
Figure 8B:
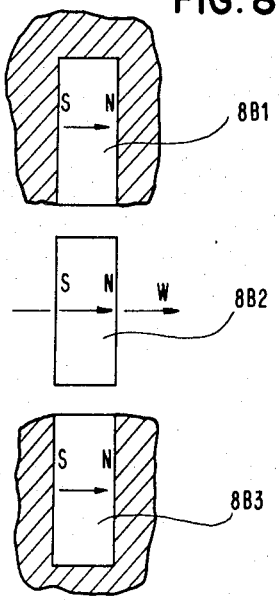
FIG. 8B is a simplified representation of a symmetrical double magnet edge for magnetic edge forces in the case of parallel and uni-directional magnetization.

FIGS. 8A and 8B show symmetrical double magnet edges for parallel magnetization.

In accordance with FIG. 8A, the magnet 8A2 is moved in the direction W between the magnets 8A1 and 8A3. The direction of magnetization in all magnets is parallel to the operating direction W; however, the magnetization in the movable magnet 8A2 extends anti-parallel to that in the stationary magnets 8A1 and 8A2. Analogously to what has been said in connection with FIG. 5B, the arrangement of FIG. 8A is an attractive configuration at *close range.*

Analagously to the arrangement of FIG. 5A, the configuration of FIG. 8B has repulsive edge forces at close range. In the latter configuration a magnet 8B2 movable in the direction W is moved in between two stationarily arranged magnets 8B1 and 8B3. Magnetization in all magnets is unidirectional and parallel to the operating direction W.

As previously pointed out, the representation of FIG. 6 can also be applied in approximation to the close range of the arrangements of FIG. 5A and FIG. 5B. Thus, this also holds for the configurations shown in FIG. 8A and FIG. 8B. Similarly, the representations in accordance with FIG. 9 and FIG. 10 can also be applied in approximation to the configuration of FIG. 8B, which is repulsive at close range.

Figure 2:
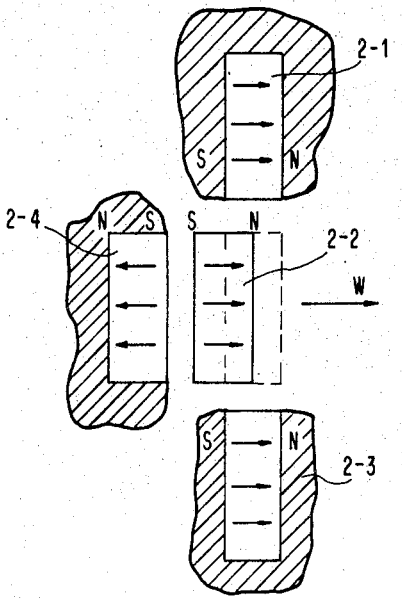
FIG. 2 is a typical representation of a magnet edge holding system consisting of a double magnet edge for magnetic edge forces in the case of parallel magnetization and of magnets effecting a contact-free holding position.

FIG. 2 is a typical representation of a magnet edge holding system consisting of a symmetrical double magnet edge for edge forces in the case of parallel magnetization and of a magnet causing a potential trough. The magnets forming the symmetrical double magnet edges are designated as 2-1, 2-2, and 2-3. The two magnet edges are formed between the magnets 2-1 and 2-2 on the one hand and between the magnets 2-2 and 2-3 on the other. Magnetization in said magnets 2-1, 2-2, and 2-3 is to extend parallel to the operating direction W of the magnet 2-2. As shown in FIG. 2, the direction of magnetization in all three magnets 2-1, 2-2, and 2-3 is to be the same. The function of the arrangement initially consisting of said three magnets has been referred to in connection with FIG. 8B. The course of forces existing for the configuration in accordance with FIG. 8B and which is a function of the distance between the movable magnet and its position d0 aligned relative to the permanently arranged magnets, essentially corresponds to the representation in accordance with FIG. 6. That means, also in this configuration, the magnet 8B2 in the position d0 is not subject to a force acting in the direction W; however, this position is unstable, since in the case of the slightest displacement in the direction W or opposite thereto, repulsive forces occur, driving said magnet from said position. Therefore, analagously to the arrangement of FIG. 3, the position of said magnet 8B2 in FIG. 8B $\hat{=}$ 2-2 in FIG. 2 must be rendered stable by the addition of a further magnet 2-4. Physically, this additional magnet 2-4 is permanently arranged, its magnetization extending anti-parallel to that of the magnet 2-2. By superimposing the potentials of the magnet 2-4 and those of the arrangement consisting of the magnets 2-1, 2-2, and 2-3, a course of the total potential corresponding to the curve ES in FIG. 9 with a trough, whose vertex represents the relatively stable position (marked by solid lines in FIG. 2) of the movable magnet 2-2, is obtained also in this case. This stable position of the magnet 2-2 is on the left of the position marked by a broken line, in which the magnet 2-2 would be aligned relative to the magnets 2-1 and 2-3. The course of forces for the arrangement in accordance with FIG. 2 essentially corresponds to the representation in FIG. 10, so that in this connection repetitive remarks regarding the relatively stable position of the point P1 and the unstable position of the point P2 can be omitted. However, it is again pointed out that the potential trough can be formed by a corresponding mechanical spring bias instead of by the magnet 2-4, as mentioned in connection with the arrangement of FIG. 3. With regard to providing the moving coil print hammer drive in accordance with the invention with a magnet edge holding system, a magnet configuration of FIG. 2 is particularly advantageous. This is because in the acceleration phase and beyond point P2 the repulsive forces *add up* ($\hat{=}$d0) (FIG. 10, FIG. 11) in the operating direction W. In this case, the repulsive edge forces formed between the magnets 2-1/2-2 and 2-2/2-3 and the repulsive forces formed between the magnets 2-4 and 2-2 add up.

The arrangements in accordance with FIG. 2 and FIG. 3 have this advantage in common. However, the configuration in accordance with FIG. 2 has an additional advantage resulting from the better use of the magnet material; an improved localized edge effect is obtained, since the pole faces of the magnets 2-1/2-2/2-3 and the magnets 2-4/2-2 acting on each other are greater than in FIG. 3 and extend perpendicularly to the operating direction W.

A schematic representation of a moving coil print hammer drive with a magnet edge holding system in accordance with the invention is shown in FIG. 1. Between two magnets 6 and 7 there is a moving coil body movable in the direction P. This moving coil body is permeated by the magnetic field M formed between the magnets 6 and 7. A helical coil 2 is cast into the moving coil body 1. The moving coil body 1 is supported by two leaf springs 3 and 4 fixed to a base 8. These leaf springs permit the moving coil body to move in the direction P. Other suitable means for fixing the moving coil body to the base 8 are equally conceivable. On its upper part, the moving coil body 1 carries the print hammer 5. Electrical connection of the moving coil 2 may be effected via the holding springs 3 and 4. When the moving coil is electrically energized, a force is exerted on the moving coil body 1 in the direction of print P. As previously mentioned, print pulse energization of the moving coil body is to be effected only after the coil body has been accelerated to a particular initial speed. The print coil body is initially accelerated in that, by means of a magnet edge holding system, for example, in accordance with FIG. 2, it is kept in a holding position, then it is moved out of this holding position by applying a small force (in the direction P), that, subsequently, it is accelerated, and only then subjected to print pulse energization. On the narrow back side of the moving coil body 1 there is a magnet 10 corresponding to the magnet 2-2 in FIG. 2. For the formation of two magnet edges, the magnets 9 and 11 are provided which are permanently connected to the base 8. These magnets 9 and 11 correspond to the magnets 2-3 and 2-1 in FIG. 2. At a corresponding distance from magnet 10, a magnet 12 is provided on the base 8. The function of this magnet 12 corresponds to that of the magnet 2-4 in FIG. 2. With regard to the directions of magnetization of the magnets 9, 10, 11, and 12, attention is drawn to the representation in FIG. 2. The function of this magnet edge holding system may be seen from the description of FIGS. 2 and 3. Initially, the magnet 10 assumes a relatively stable position corresponding to point P1 (see FIGS. 9 and 10). By applying a slight release force—which must be at least of such magnitude that it causes the system to be moved beyond the position corresponding to point P2 (FIGS. 9 and 10)—the moving coil body 1, rigidly connected to the magnet 10, is subjected in the direction of print to a force released in accordance with FIG. 10. By means of this force, the moving coil body 1 is accelerated, being given the initial speed required. The release force for the magnet edge holding system may be produced by a slight moving coil energization. It is explicitly pointed out that this initial energization of the moving coil to release the moving coil body from the relatively stable position has nothing to do with the actual energization of the moving coil for printing. The moving coil is actually energized only after the moving coil body 1 has reached a particular initial speed. If only relatively small print forces are required, the initial energization of the moving coil without the subsequent primary energization for printing might be sufficient. It has been found that in the case of optimum print energization, the time function of the control variable of the moving coil (for the actual print process) corresponds to the time function of the speed of the moved coil. When looking at the energy conditions in the representation according to FIG. 9, it will be found that relatively little energy is required to move the system from its relatively stable position P1 to a position beyond point P2. The energy which is subsequently automatically released and which initially accelerates the moving coil body 1 in the direction of print, can at a corresponding path length be disproportionally greater than the release energy. In other words, the force to be applied to release the magnet edge holding system beyond point P2 can be disproportionally smaller than the force becoming automatically effective in the direction of print after release.

If the magnet 12 in FIG. 1 is to be functionally replaced by a suitably acting spring, such a spring would have to be arranged in such a manner that the repulsive edge forces in the relatively stable holding position are compensated by the counterforce of the spring. Such a spring could be designed, for example, as a pressure spring forcing the moving coil in the direction P, while maintaining it in the relatively stable holding position. For this purpose the spring would have to be designed in such a manner that it is untensioned in the course of printing, without exerting any tensile forces. A symmetrical double magnet edge system, whose function resembles that of the arrangement shown in FIG. 2, is schematically represented in FIG. 11. While the arrangement of FIG. 2 requires a total number of four individual magnets, this number can be minimized in the arrangement of FIG. 11. For this purpose, however, the magnets 11-1, 11-2, and 11-3 have to be specially designed. The magnet 11-2 movable in the direction W has not a rectangular but a triangular cross-section, the stationary magnets 11-1 and 11-3 being sloped to match the triangular shape. The magnetization of the three magnets 11-1, 11-2, and 11-3 corresponds to the direction of the arrows. The function of the arrangement in accordance with FIG. 11 is such that the sloped front faces of the stationary magnets 11-1 and 11-3 together with the sloped face of the movable magnet 11-2 produce a reciprocal action of repulsive forces (which corresponds to the repulsive effect of the magnets 2-4/2-2 in FIG. 2). The reciprocal action of the pole faces 11-1-0, 11-2-0, and 11-1-0 on the other hand leads to an attractive edge force (similar to the arrangement of FIG. 8A) at close range. At a suitable geometric design with regard to the angle and thickness of the magnet 11-2, the reciprocal action of the two components leads to the relatively stable holding position required.

It is pointed out that the magnets 11-1 and 11-3 can also be combined to form a single magnet with a corresponding wedge-shaped recess to accommodate the magnet 11-2-0.

Figure 12:
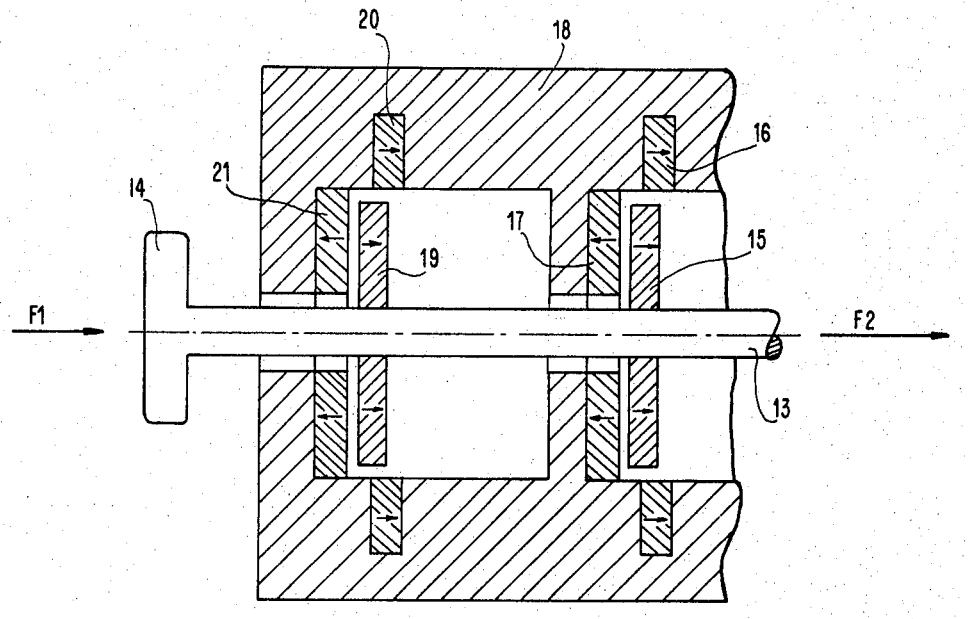
FIG. 12 if a schematic representation of a magnet edge holding system for general applications, in which a high action force is obtained by means of a relatively low release force.

FIG. 12 is a schematic sectional representation of a magnet edge holding system for general applications, whereby a high action force is obtained by using a relatively low release force. In this arrangement, several magnet edge holding systems are simultaneously provided, each corresponding, for example, to one of the arrangement in accordance with FIG. 2. However, in this case, the magnets are annularly shaped. The magnetizations in the individual magnets correspond to the arrow-marked direction. The magnet ring 15 (and 19, respectively) is supported on and permanently connected to a shaft 13. The shaft 13 is movable in the direction of the arrow relative to the stationary base 18 surrounding it. Into this base a magnet ring 16 (and 20, respectively) is inserted in such a manner that edge forces become active between the latter and the magnet ring 15 (and 19, respectively) arranged on the shaft. On a protrusion of the base 18, which is annularly shaped in the direction of the shaft axis, a further magnet ring 17 (and 21, respectively) is arranged in such a manner that it keeps the magnet ring 15 (and 19, respectively) connected to the shaft 13 in a relatively stable position. At a relatively low release force F1 against the shaft knob 14, the magnets 15 (and 19, respectively) are forced out of their relatively stable holding position until from a particular point onward, which corresponds to point P2 in curve 10, a high action force F2 is released, accelerating the shaft in the direction of the arrow F2. The release force F1 can be applied manually or by other means. The magnet edge holding system of FIG. 12 can be used for a variety of applications. Thus, it is conceivable, for example, that a switch element in particular switches must be activated rapidly and at a high force F2. For such purposes it is, of course, of great advantage when the release of such a switch with a magnet edge holding system requires only a low force F1 which is subsequently transformed into a much higher and automatically released action force F2.

Figure 13:
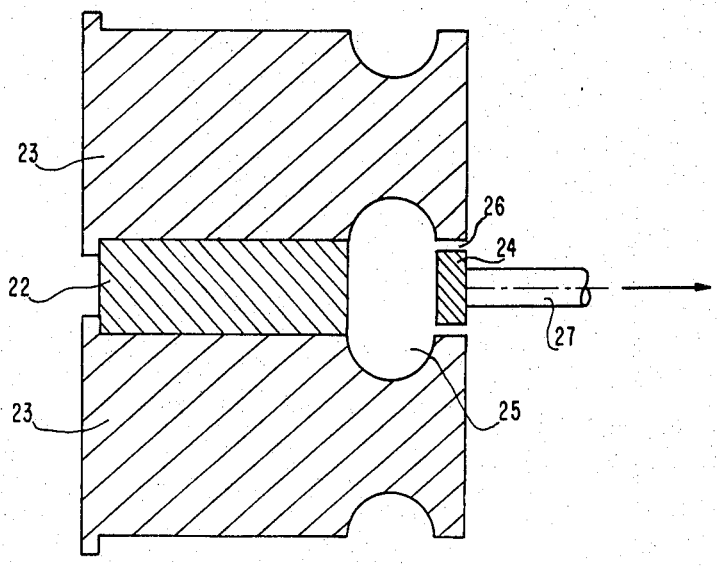
FIG. 13 is a schematic representation of a double magnet edge holding system consisting of a single magnet arranged in a soft iron magnet circuit.

FIG. 13 shows a symmetrical double magnet edge holding system which consists of only one single magnet in a soft iron magnet circuit. The magnet 22 is arranged between two yoke parts 23 of soft iron. The magnetic circuit is closed via the two air gaps 26 and a soft iron circuit 24 movable between them in the direction of the arrow. The soft iron circuit 24 is fixed to a shaft 27. As by means of soft iron only attractive magnet forces can be realized, this configuration corresponds to the arrangement of FIG. 7A. Because of the high magnetic induction obtainable by means of soft magnetic materials, high holding forces at very thin magnet edges can be realized in the arrangement of FIG. 13. This arrangement requires a spring (not shown) acting on the moving element to form a release threshold.

The relatively stable holding position is produced against the tension of the spring by the attractive magnet edge forces (FIG. 14). By the application of an external force, the moving element 27 can be transferred to a position P3 in which the spring tension exceeds the attractive edge forces. Further details may be seen from FIG. 14.

In FIG. 14, similar to FIG. 6, the absolute magnitude of the force F is shown (solid line curve) as a function of the distance d (for the attractive configuration of FIG. 13). In view of FIG. 6, this curve need not be described further. The spring characteristic (broken line curve) is to intersect the magnet edge characteristic at points P2 and P3. This means, point P2 represents the relatively stable position (spring tension=attractive edge force). If, by means of an external force, the system is transferred from P2 to point P3, the spring tensions exceed the attractive edge forces from this point onward as the distance d increases, and the moving element is accelerated by the energy originating from the spring.

Having thus described my invention, what I claim as new, and desire to secure by Letters Patent is:

1. An actuator mechanism comprising
a movable actuator element,
an actuator magnet carried by said actuator element,
said actuator magnet comprising a permanent magnet having a magnetization vector perpendicular to the direction of motion of said actuator element, and a magnet system interactive with said actuator magnet for providing a contactless magnetic holding and accelerating force for said actuator element,
said magnet system comprising
field magnet means forming an interactive field with said actuator magnet having a first magnetic field region having an unstable high potential position for producing a magnetic accelerating force on said actuator magnet and a second magnetic field region adjacent said first magnetic field region for producing a stable magnetic field holding position of relatively high potential in the vicinity of said first field region,
said field magnet means forming said first magnetic field region comprising first stationary permanent field magnets having magnetization vectors perpendicular with said direction of motion and anti-parallel with said magnetization vector of said actuator magnet, and
said field magnet means forming said second magnetic field region comprising a second stationary permanent field magnet having a magnetization vector parallel with said magnetization vector of said actuator magnet,
and operating means associated with said actuator element for application of a release force capable of displacing said actuator element from said stable magnetic field holding position to said unstable accelerating force position of said first magnetic field region.

2. An actuator mechanism in accordance with claim 1 in which
said actuator and field permanent magnets are rectangular,
said first field magnets are aligned edgewise with and on opposite sides of said actuator magnet in said unstable position and
said second field magnet is staggered relative to said first field magnets.

3. An actuator mechanism comprising
a movable actuator element,
an actuator magnet carried by said actuator element,
said actuator magnet comprising a permanent magnet having a magnetization vector parallel with the direction of motion of said actuator element, and
a magnet system interactive with said actuator magnet for providing a contactless magnetic holding and accelerating force for said actuator element,
said magnet system comprising
field magnet means forming an interactive field with said actuator magnet having a first magnetic field region having an unstable high potential position for producing a magnetic accelerating force on said actuator magnet and a second magnetic field region adjacent said first magnetic field region for producing a stable magnetic field holding position of relatively high potential in the vicinity of said first field region,
said field magnet means forming said first magnetic field region comprising first stationary permanent field magnet means having magnetization vectors parallel with said magnetization vector of said actuator permanent magnet, and
said field magnet means forming said second magnetic field region comprising a second stationary permanent field magnet means having a magnetization vector anti-parallel with said magnetization vector of said actuator magnet,
and operating means associated with said actuator element for application of a release force capable of displacing said actuator element from said stable magnetic field holding position to said unstable accelerating force position of said first magnetic field region.

4. An actuator mechanism in accordance with claim 3 in which
said actuator and field permanent magnets are rectangular,
said first permanent field magnet means are aligned edgewise with and on opposite sides of said actuator magnet when in said unstable position, and
said second permanent field magnet means is staggered relative to said first field magnets.

5. An actuator mechanism in accordance with claim 3 in which
said actuator magnet and said field magnet means are annular said first permanent field magnet means is aligned edgewise with said actuator magnet when in said unstable position, and said second field magnet is staggered relative to said first field magnet means.

6. An actuator mechanism in accordance with claims 5 in which said actuator element is a horizontal shaft having at least one annular actuator magnet movable therewith relative to said field magnet means, said shaft having means for application of a manual release force.

* * * * *